US006807833B1

(12) United States Patent
Huang et al.

(10) Patent No.: US 6,807,833 B1
(45) Date of Patent: Oct. 26, 2004

(54) UNLOCKING DEVICE FOR A LEVER HANDLE DOOR LOCK

(75) Inventors: Lan-Shi Huang, Kaohsiung (TW); Chun-Cheng Lin, Kaohsiung Hsien (TW)

(73) Assignee: Taiwan Fu Hsing Industrial Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 10/714,669

(22) Filed: Nov. 18, 2003

(51) Int. Cl.[7] ..... E05B 13/10; E05B 59/00; E05B 63/14

(52) U.S. Cl. ..... 70/107; 70/215; 70/217; 70/224; 70/467; 70/473; 70/475; 70/477; 70/478; 70/485

(58) Field of Search ..... 70/107, 110, 111, 70/210, 224, 215–217, 467–485, 489; 292/34, 36, 169.14–169.17, 169.21–169.23

(56) References Cited

U.S. PATENT DOCUMENTS 2,959,952 A * 11/1960 Schweitzer ..... 70/467
2,998,274 A * 8/1961 Russell ..... 292/169.17
5,372,025 A * 12/1994 Lin ..... 70/472
5,657,653 A * 8/1997 Hensley et al. ..... 70/224
5,784,909 A * 7/1998 Huang ..... 70/224
6,223,567 B1 * 5/2001 Fadul ..... 70/149
6,360,569 B1 * 3/2002 Huang ..... 70/215
6,742,367 B2 * 6/2004 Wu ..... 70/224
2003/0106355 A1 * 6/2003 Huang ..... 70/224

FOREIGN PATENT DOCUMENTS

CA 509571 * 1/1955 ..... 70/482
IT 295110 * 4/1932 ..... 70/217

* cited by examiner

*Primary Examiner*—Lloyd A. Gall
(74) *Attorney, Agent, or Firm*—Bacon & Thomas PLLC

(57) ABSTRACT

An unlocking device for the lever handle door lock includes an inner lever, an outer lever, an inner mounting plate, an outer mounting plate, a spindle, an inner actuating rod and an outer actuating rod. The inner mounting plate and the outer mounting plate mount the inner lever and the outer lever. Each of the inner lever and the outer lever has an assembling hole so that the inner lever and the outer lever are correspondingly connected to the inner actuating rod and the outer actuating rod for separately operating a latch bolt unit. The inner actuating rod has an end capable of disengaging from that of the outer actuating rod so as to avoid driving the inner actuating rod.

7 Claims, 11 Drawing Sheets

UNLOCKING DEVICE FOR A LEVER HANDLE DOOR LOCK

BACKGROUND OF THE INVENTION

1. Field of the Invention

The present invention is related to an unlocking device for a lever handle door lock. More particularly, the present invention is related to the unlocking device to separately actuate the lever handle door lock in locking state by turning an inner lever.

2. Description of the Related Art

Referring initially to FIG. 13, a conventional tubular lock includes an inner knob 91 and a locking button 911 thereof for locking. The tubular lock further includes an outer knob 92 and a lock core 962, which are used to rotate an actuating rod 93 and thus to push a shaft 94 and a limiting plate 95. The actuating rod 93 bears at least one protrusion 931 which engages with an inclined surface 941 of the shaft 94 so as to move the protrusion 931 along the inclined surface 941. The limiting plate 95 provides with at least one tooth 951. Moving in an axial direction, the limiting plate 95 causes an engagement/disengagement of the tooth 951 with/from a groove 961 of a rose escutcheon 96 for locking/unlocking purpose. In the locking state, an outer knob 92 is unable to turn a spindle 97 to operate a latch bolt unit (not shown). In the unlocking operation, turning the lock core 962 by a correct key results in a release of the tooth 951 from the groove 961 to allow returning the actuating rod 93, or turning the inner knob 91 results in a turning movement of the shaft 94. When the protrusion 931 of the actuating rod 93 stops at a bottom of the inclined surface 941 of the shaft 94, the limiting plate 95 releases from the rose escutcheon 96 for unlocking purpose. In use, the shaft 94 connects to an auxiliary lock (not shown) to operate for locking or unlocking it. In the unlocking state, turning the outer knob 92 is able to rotate the spindle 97 and the shaft 94 that result in an unlocking drive of the auxiliary lock. Hence, there is a need for an outer lever for a tubular lock assembly or a lever handle door lock which can avoid an outer lever driving an auxiliary lock.

The present invention intends to provide an unlocking device for a lever handle door lock, which can avoid an outer lever, in the unlocking state, driving an inner actuating rod to rotate in such a way to mitigate and overcome the above problem.

SUMMARY OF THE INVENTION

The primary objective of this invention is to provide an unlocking device for a lever handle door lock, which can avoid an outer lever, in the unlocking state, driving an inner actuating rod to rotate that can prevent the outer lever inadvertently unlocking an auxiliary lock.

The secondary objective of this invention is to provide the unlocking device for the lever handle door lock, which consists of an inner actuating rod and an outer actuating rod separately driven by an inner lever and an outer lever.

The unlocking device for the lever handle door lock in accordance with the present invention includes an inner lever, an outer lever, an inner mounting plate, an outer mounting plate, a spindle, an inner actuating rod and an outer actuating rod. The inner mounting plate and the outer mounting plate mount the inner lever and the outer lever on a door. Each of the inner lever and the outer lever has an assembling hole so that the inner lever and the outer lever are correspondingly connected to the inner actuating rod and the outer actuating rod for separately operating a latch bolt unit. The inner actuating rod is axially aligned with the outer actuating rod and has an end capable of disengaging from that of the outer actuating rod so as to avoid the outer lever driving the inner actuating rod.

Other objectives, advantages and novel features of the invention will become more apparent from the following detailed description and the accompanying drawings.

BRIEF DESCRIPTION OF THE DRAWINGS

The present invention will now be described in detail with reference to the accompanying drawings herein.

DETAILED DESCRIPTION OF THE INVENTION

Figure 1:
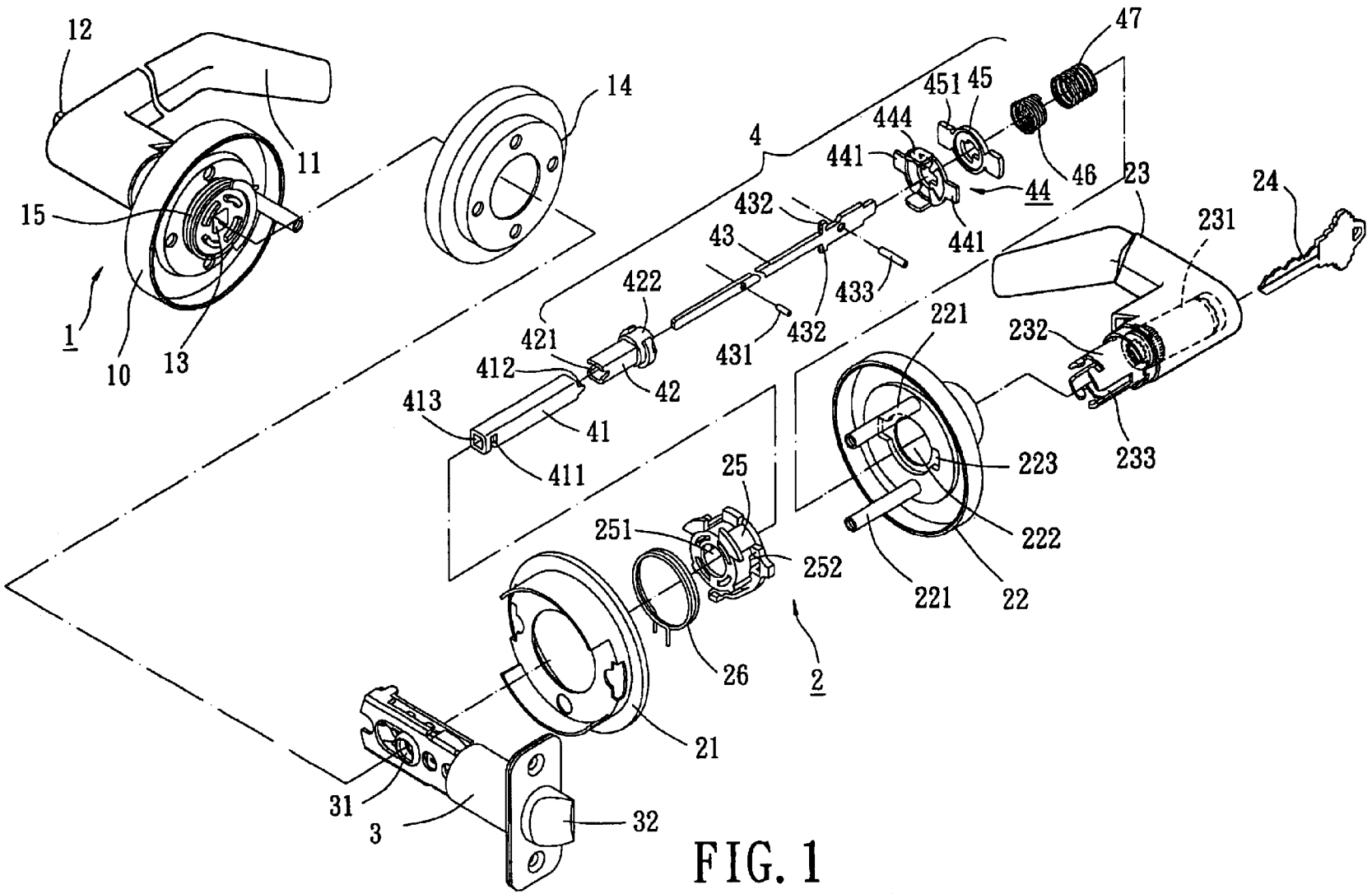
FIG. 1 is an exploded perspective view of an unlocking device for a lever handle door lock in accordance with a preferred embodiment of the present invention.
Figure 2:
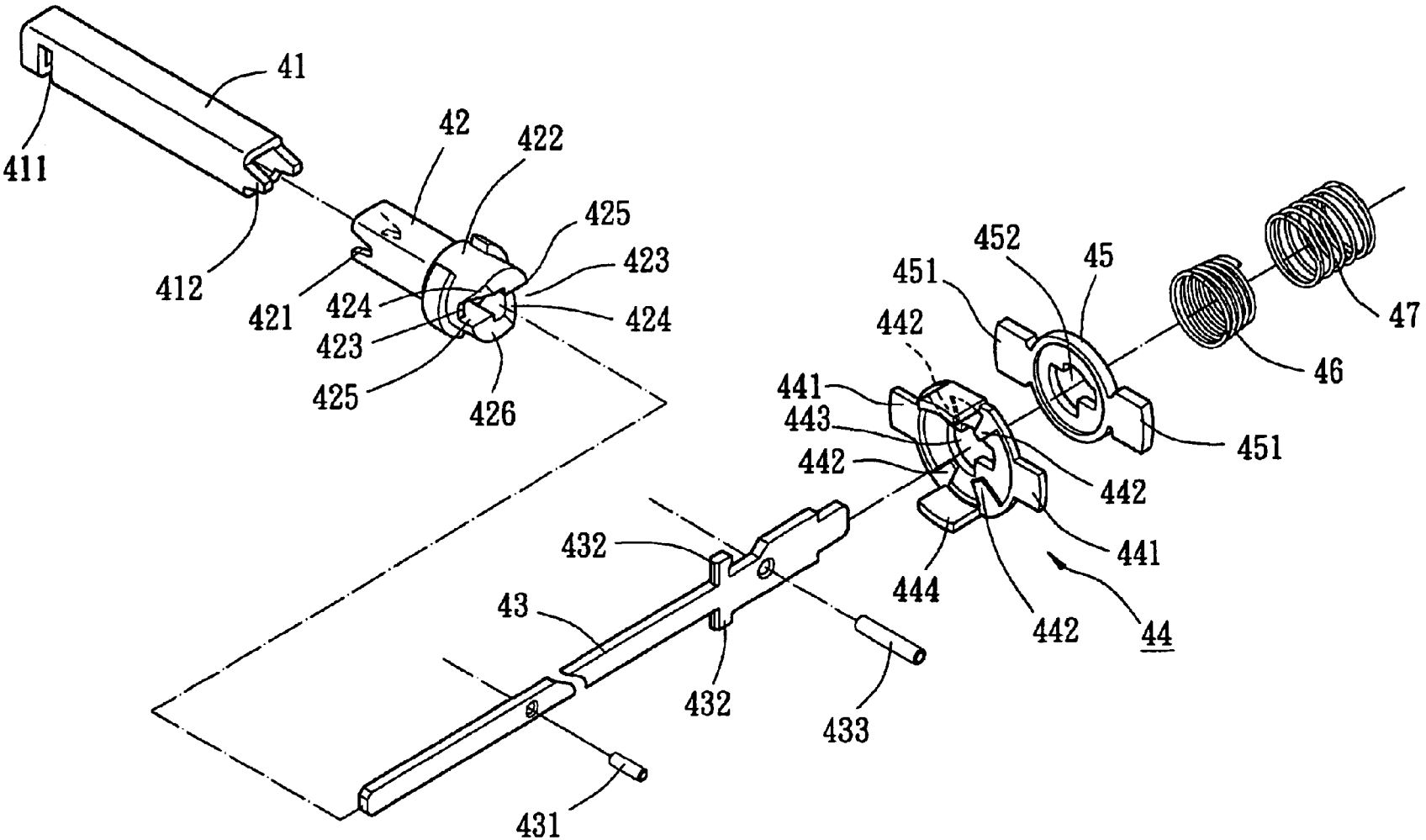
FIG. 2 is an exploded perspective view of the unlocking device in accordance with the preferred embodiment of the present invention for the lever handle door lock of FIG. 1.
Figure 3:
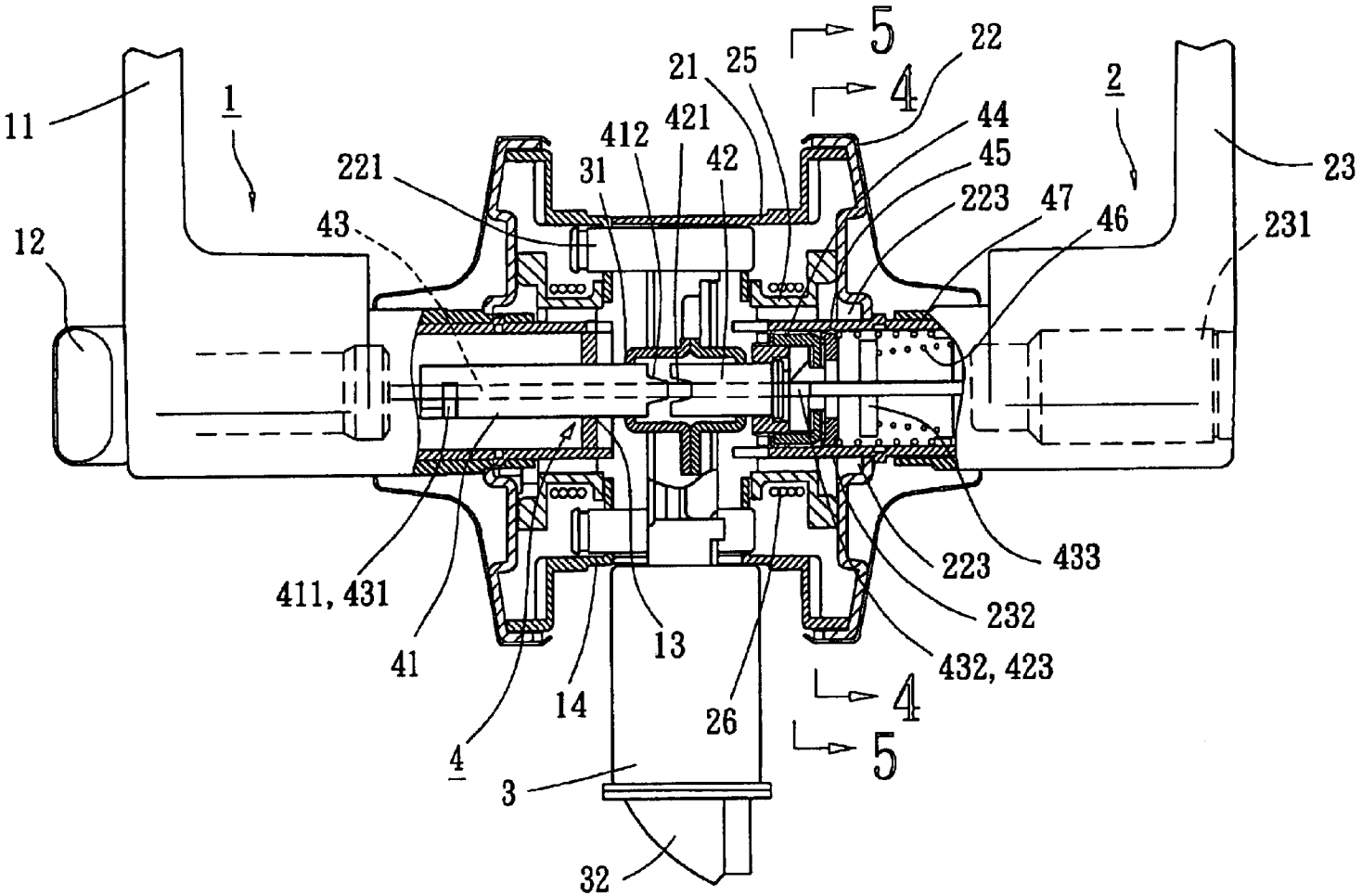
FIG. 3 is a partial cross-sectional view of the unlocking device for the lever handle door lock in accordance with the preferred embodiment of the present invention.
Figure 4:
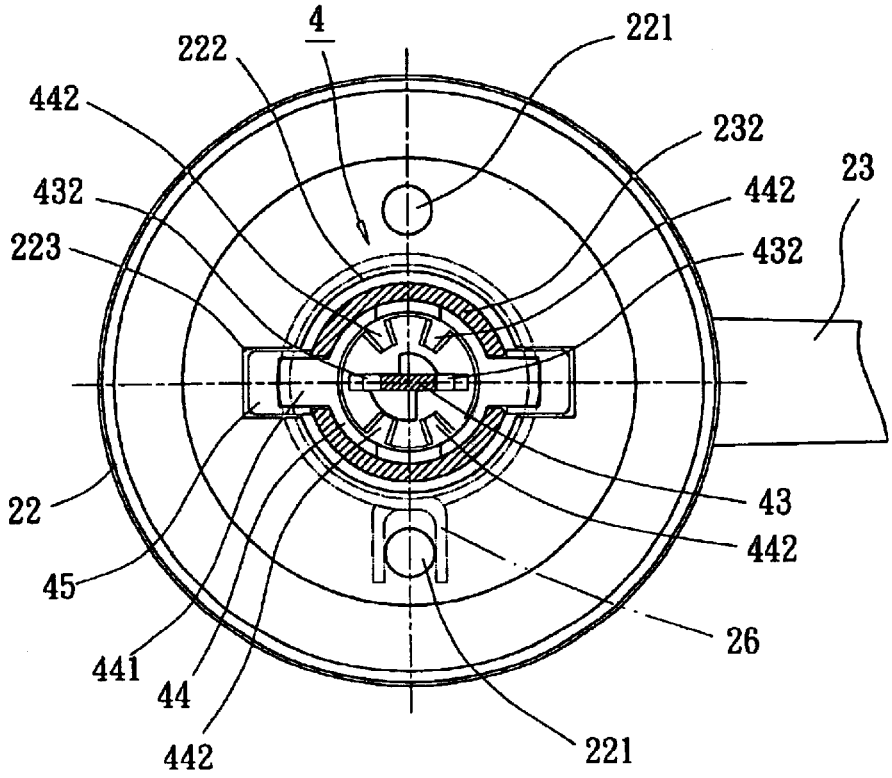
FIG. 4 is a partial cross-sectional view, taken along line 4—4 in FIG. 3, of the unlocking device for the lever handle door lock in accordance with the preferred embodiment of the present invention.
Figure 5:
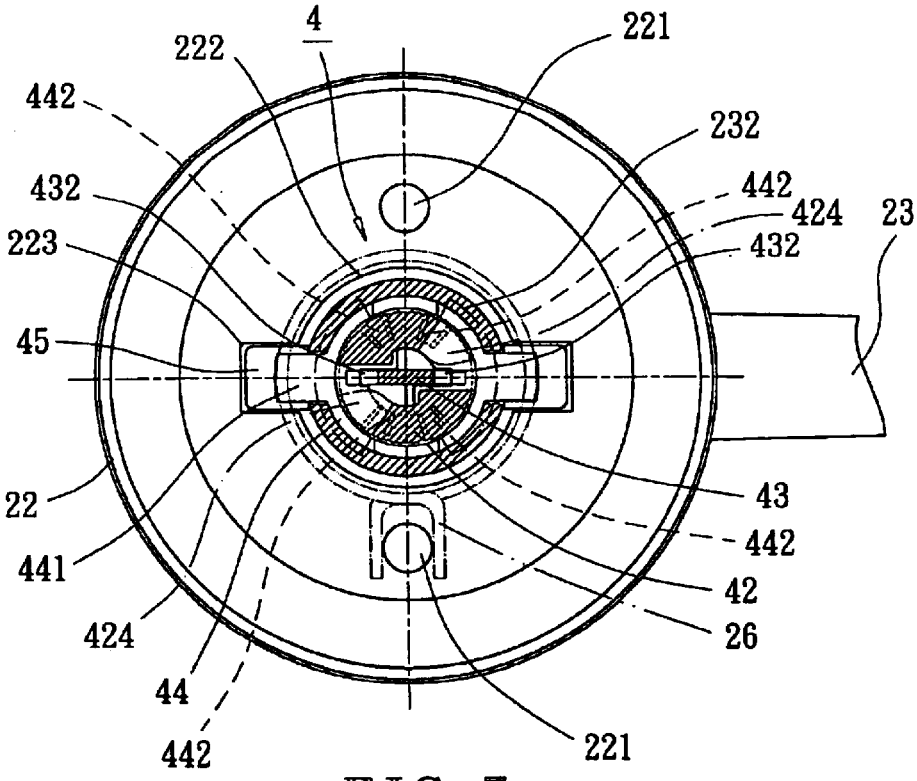
FIG. 5 is a partial cross-sectional view, taken along line 5—5 in FIG. 3, of the unlocking device for the lever handle door lock in accordance with the preferred embodiment of the present invention.

Referring to FIGS. 1 through 3, a lever handle door lock having an unlocking device in accordance with a preferred embodiment of the present invention includes an inner lever mechanism 1, an outer lever mechanism 2, a latch bolt unit 3 and a latch bolt actuating unit 4.

Construction of the inner lever mechanism 1 shall be described in detail, referring again to FIGS. 1 and 3. The inner lever mechanism 1 is installed in an interior and fixed on a bored hole of a door by a mounting plate 14. The mounting plate 14 is combined with a rose escutcheon 10 to which an inner lever 11 is pivotally connected. The inner lever mechanism 1 provides with a returning spring 15 for returning the inner lever 11. Furthermore, the inner lever mechanism 1 includes a locking button 12 and a non-circular assembling hole 13. To accomplish the assembling purpose, the non-circular assembling hole 13 allows connection of the inner lever mechanism 1 with the latch bolt actuating unit 4, and operation of the inner lever 11 to turn the latch bolt actuating unit 4.

Construction of the outer lever mechanism 2 shall be described in detail, referring again to FIGS. 1 and 3. The outer lever mechanism 2 is installed on an outside and fixed on a bored hole of a door by a mounting plate 21. The mounting plate 21 is combined with a rose escutcheon 22 to which an outer lever 23 is pivotally connected. The rose escutcheon 22 is formed with a pair of nuts 221 adapted to screw-connect with screw members of the inner lever mechanism 1, and an axial hole 222 adapted to accommodate a lock core 231 which allows a correct key 24 to actuate the latch bolt actuating unit 4. The rose escutcheon 22 is further formed with a pair of locking recessions 223. The outer lever mechanism 2 provides with an axial tube 232 and a pair of longitudinal grooves 233 thereof to combine with a returning member 25 and a returning spring 26 thereof. When the turned outer lever 23 is released, the returning member 25 and the returning spring 26 returns the outer lever 23 to an original position.

Construction of the latch bolt unit 3 shall be described in detail, referring again to FIGS. 1 and 3. The latch bolt actuating unit 4 is able to operate the latch bolt unit 3. The latch bolt unit 3 has a pair of cams 31 located at either side adjacent to the inner lever mechanism 1 or the outer lever mechanism 2. The latch bolt unit 3 includes a latch bolt 32 which can be retracted by turning the cams 31.

Construction of the latch bolt actuating unit 4 shall be described in detail, referring back to FIGS. 1 and 2. The latch bolt actuating unit 4 includes a first actuating rod 41, a second actuating rod 42, an actuating stick 43, a limiting plate 44, a reinforcing plate 45, a first elastic member 46 and a second elastic member 47.

The first actuating rod 41 has a first end inserted into the non-circular assembling hole 13 of the inner lever mechanism 1, and provided with a guiding groove 411. Alternatively, the first actuating rod 41 has a second end combined with one of the cams 31 of the latch bolt unit 3, and provided with an engaging protrusion 412. The first actuating rod 41 is a hollow tube 413 to allow passage of the actuating stick 43.

The second actuating rod 42 has a first end combined with the other of the cams 31 of the latch bolt unit 3, and provided with an engaging groove 421 for engaging/disengaging with/from the engaging protrusion 412 of the first actuating rod 41. Alternatively, the second actuating rod 42 has a second end provided with a control cylinder on which formed with a pair of notches 422. As best shown in FIG. 2, the second end of the second actuating rod 42 provides with a pair of gaps 423 on its end surface 426. Each of the gaps 423 consists of an inclined surface 424 and a vertical surface 425. Referring back to FIG. 1, to accomplish correct alignment with an axis, the control cylinder of the second actuating rod 42 is connected to an axial hole 251 of the returning member 25 and rotated therewith.

The actuating stick 43 extends successively through the first actuating rod 41 and the second actuating rod 42, and has a first end connected with the locking button 12 of the inner lever mechanism 1 so that the locking button 12 is able to turn the actuating stick 43. The actuating stick 43 further has a second end combined with the lock core 231 of the outer lever mechanism 2 so that the correct key 24 is able to turn the actuating stick 43 via the lock core 231. The actuating stick 43 provides with a guiding rod 431 to confine itself within angular length of the guiding groove 411 of the first actuating rod 41, and a pair of lugs 432 to engage with the gaps 423 of the second actuating rod 42. Since the guiding rod 431 is confined within the guiding groove 411, it constitutes a combination of the first actuating rod 41 and the actuating stick 43. In operation, each of the lugs 432 of the actuating stick 43 passes through the inclined surface 424 of the second actuating rod 42 and thus stops at the end surface 426 so that a longitudinal movement between the second actuating rod 42 and the combination of the first actuating rod 41 and the actuating stick 43 is allowed. The first actuating rod 41 is engaged/disengaged with/from the second actuating rod 42 due to the longitudinal movement of the second actuating rod 42. The second end of the actuating stick 43 is further inserted into the limiting plate 44 and the reinforcing plate 45 successively, and a positioning bar 433 is used to prevent releasing the limiting plate 44 and the reinforcing plate 45 from the actuating stick 43.

The limiting plate 44 connected to the second end of the actuating stick 43 has a pair of arms 441, a plurality of stops 442, an axial hole 443 and a pair of longitudinal legs 444. The arms 441 are engaged/disengaged with/from recessions 252 of the returning member 25 or the locking recessions 223 of the rose escutcheon 22. The axial hole 443 allows passage and rotational movement of the actuating stick 43 while the stops 442 accommodate the lugs 432 of the actuating stick 43 to thereby limit the rotational movement of the actuating stick 43. The longitudinal legs 444 are received in the notches 422 of the second actuating rod 42 to constitute a combination of the second actuating rod 42 and the limiting plate 44.

The reinforcing plate 45 is connected to the second end of the actuating stick 43 and limited by the positioning bar 433. The reinforcing plate 45 has a pair of arms 451 and an axial hole 452. The arms 451 are engaged/disengaged with/from recessions 252 of the returning member 25 or the locking recessions 223 of the rose escutcheon 22. The axial hole 452 allows passage and rotational movement of the actuating stick 43.

Turning now to FIG. 3, the first elastic member 46 and the second elastic member 47 are coaxial and nested in the axial tube 232 of the outer lever mechanism 2. The first elastic member 46 biases the positioning bar 433 of the actuating stick 43 so that the engaging protrusion 412 of the first actuating rod 41 is able to elastically engage/disengage with/from the engaging groove 421 of the second actuating rod 42. The second elastic member 47 biases the reinforcing plate 45 so that the arms 441 of the limiting plate 44 and the arms 451 of the reinforcing plate 45 bias to disengage from the locking recessions 233 of the rose escutcheon 22.

Referring to FIGS. 2 through 5, in the unlocking state, the first elastic member 46 biases the positioning bar 433 of the actuating stick 43 for disengaging and separating the engaging protrusion 412 of the first actuating rod 41 from the engaging groove 421 of the second actuating rod 42. Then, the lugs 432 of the actuating stick 43 are located in the gaps 423 of the second actuating rod 42. Meanwhile, the arms 441 of the limiting plate 44 and the arms 451 of the reinforcing plate 45 disengage from the locking recessions 223 of the rose escutcheon 22 due to the biasing force of the second elastic member 47. Under these conditions the inner lever 11 is able to turn the first actuating rod 41 and the cam 31 of the latch bolt unit 3 for retracting the dead bolt 32. Alternatively, the outer lever 23 is able to turn the second actuating rod 42 and the cam 31 of the latch bolt unit 3 for retracting the dead bolt 32. To this end, the longitudinal groove 233 of the axial tube 232 combines with the arm 441 of the combination of the limiting plate 44 and the second actuating rod 42.

Figure 6:
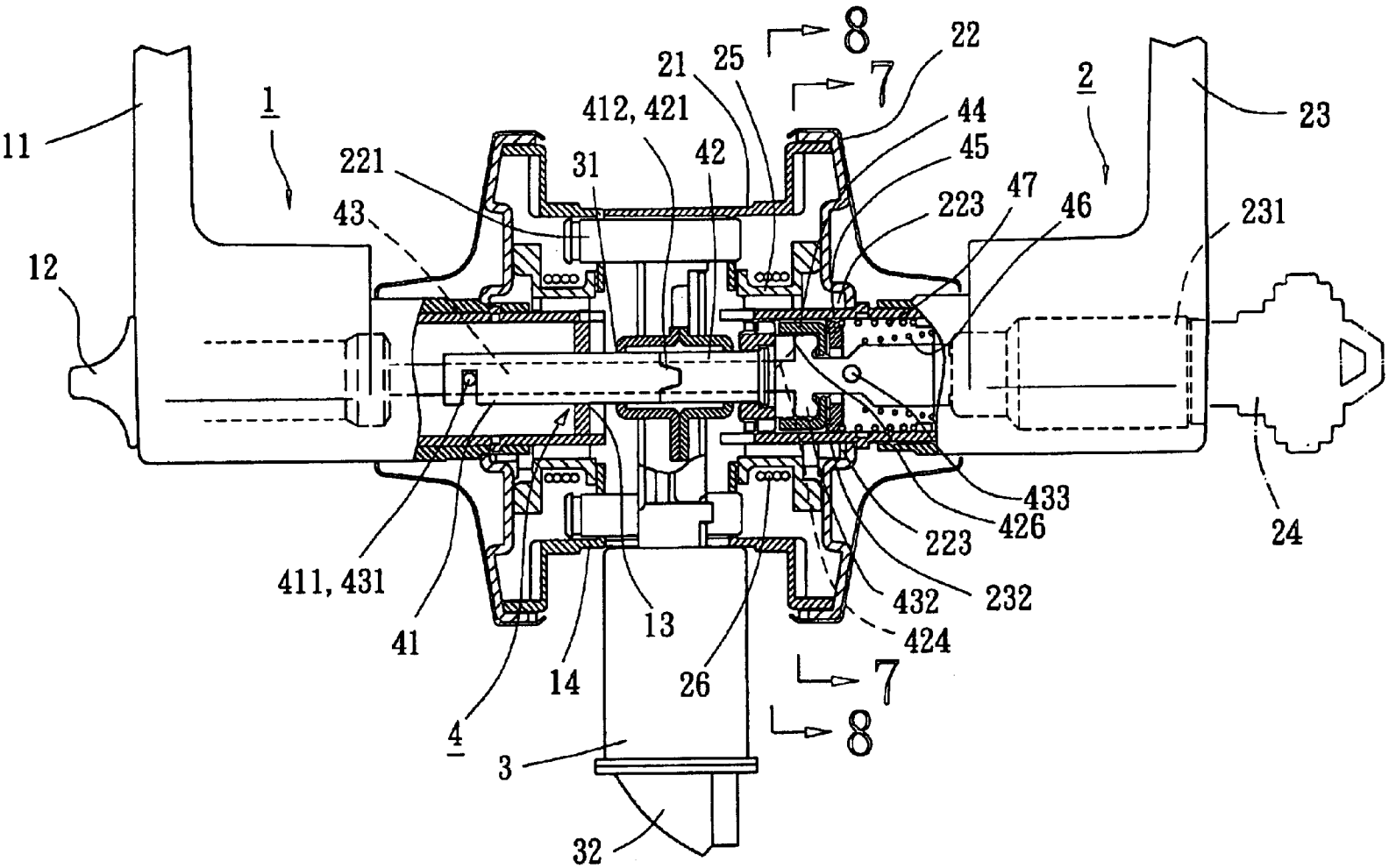
FIG. 6 is a partially cross-sectional view, similar to that of FIG. 3, of the unlocking device for the lever handle door lock, in locking state, in accordance with the preferred embodiment of the present invention.
Figure 7:
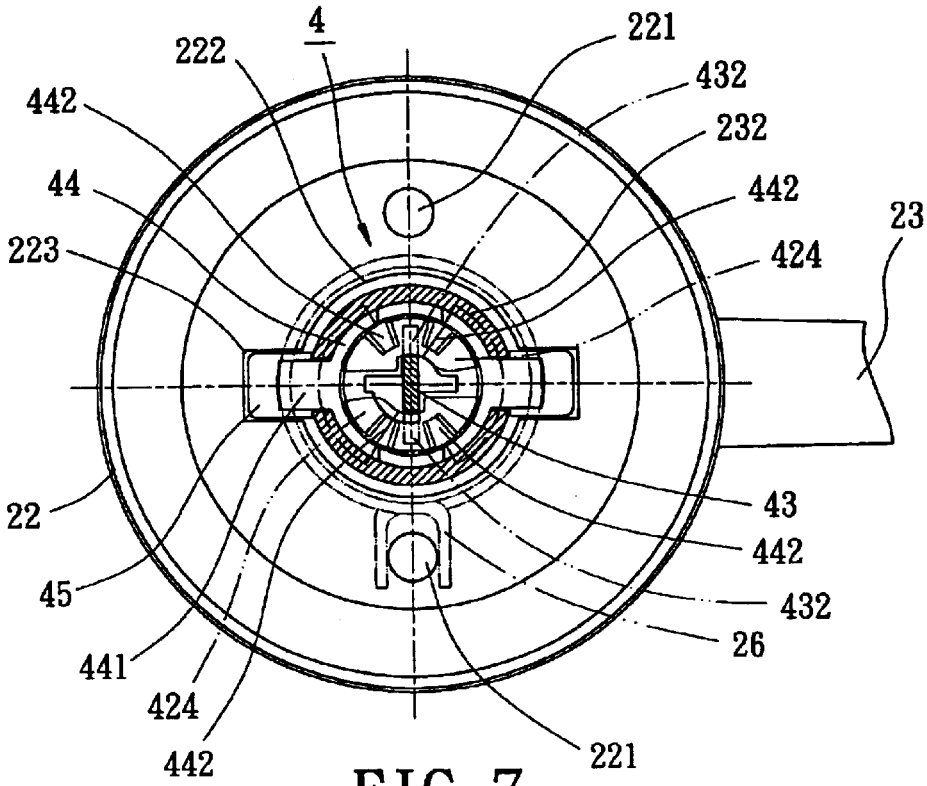
FIG. 7 is a partial cross-sectional view, taken along line 7—7 in FIG. 6, of the unlocking device for the lever handle door lock in accordance with the preferred embodiment of the present invention.
Figure 8:
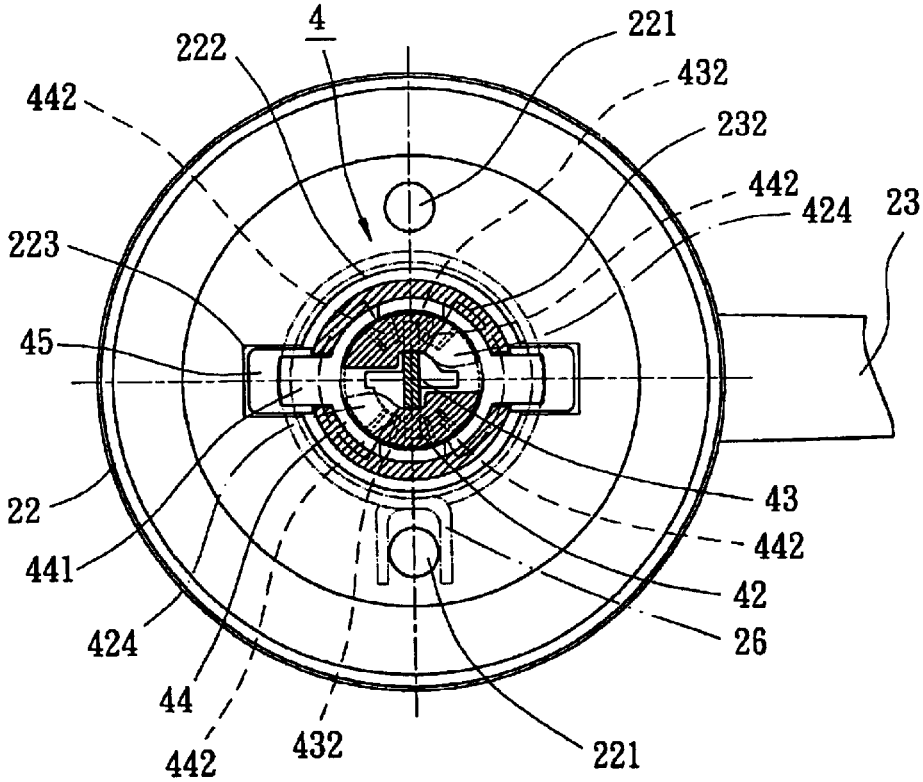
FIG. 8 is a partial cross-sectional view, taken along line 8—8 in FIG. 6, of the unlocking device for the lever handle door lock in accordance with the preferred embodiment of the present invention.

Turning now to FIGS. 6 through 8, in the locking state, when the actuating stick 43 is turned 90 degrees and stopped in a vertical direction, the lugs 432 are released from the gaps 423 of the second actuating rod 42. The lugs 432 had been passed the inclined surfaces 424, stopped at the end surface 426 and located between the second actuating rod 42 and the limiting plate 44, as best shown in FIG. 6. The actuating stick 43 and the first actuating rod 41 move together an axial distance toward the outer lever mechanism 2 so that the engaging protrusion 412 of the first actuating rod 41 is engaged with the engaging groove 421 of the second actuating rod 42. Meanwhile, the axial movement of the actuating stick 43 overcomes the biasing force of the elastic members 46 and 47, thereby the arms 441 of the limiting plate 44 and the arms 451 of the reinforcing plate 45 commonly engaging with the locking recessions 223 of the rose escutcheon 22. As best shown in FIGS. 7 and 8, turning the outer lever 23 is not allowed since the arms 441 of the limiting plate 44 and the arms 451 of the reinforcing plate 45 are commonly engaged with the locking recessions 223 of the rose escutcheon 22. Thereby, the latch bolt actuating unit 4 is locked.

Figure 9:
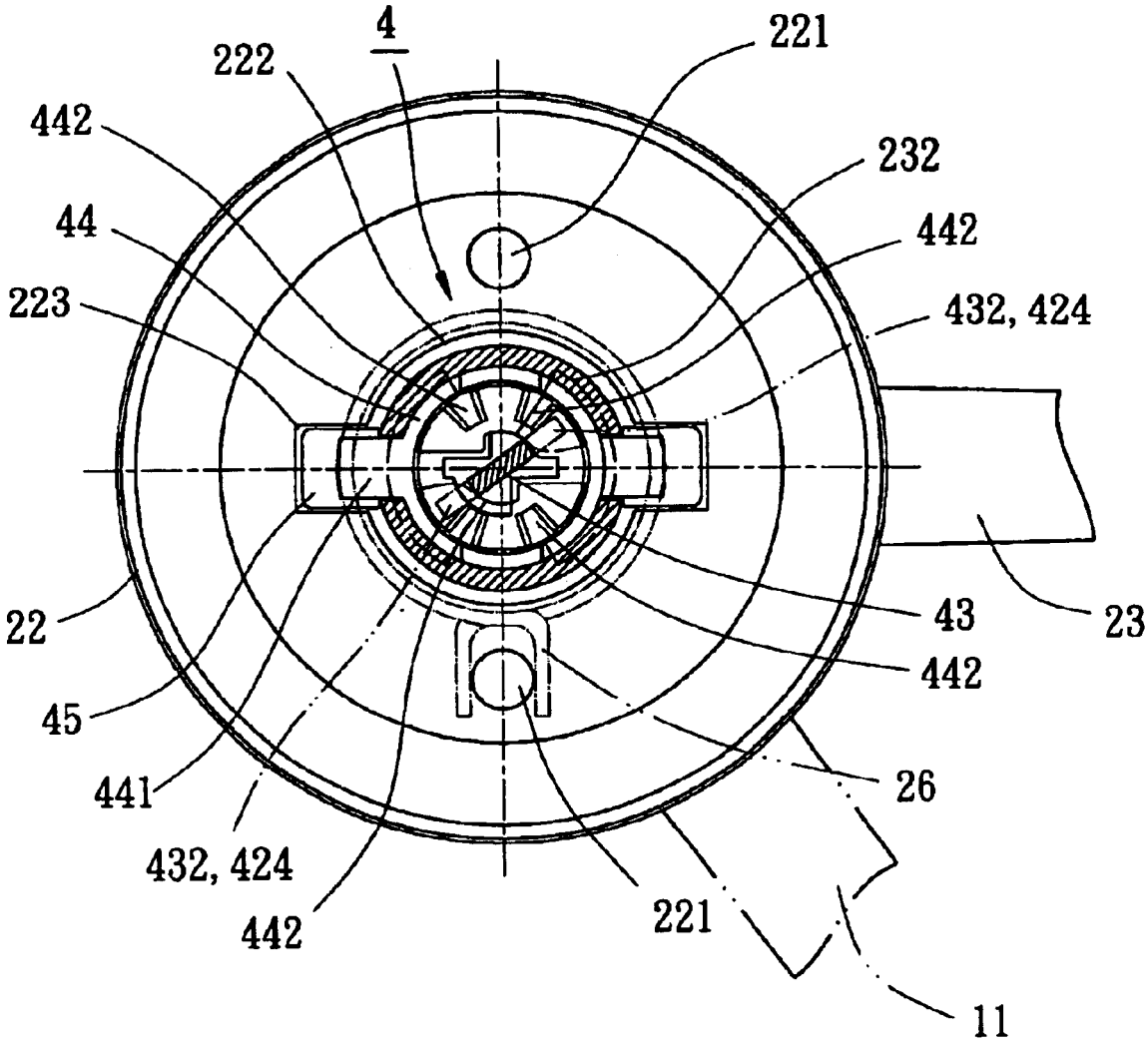
FIG. 9 is a cross-sectional view, similar to that of FIG. 8, of the unlocking device for the lever handle door lock in accordance with the preferred embodiment of the present invention when operated to unlock.

Turning now to FIG. 9, there is a need for a correct key for turning the lock core 231 and unlocking the latch bolt actuating unit 4 since the outer lever 23 is not allowed to turn. Alternatively, users can turn the inner lever 11 to unlock the latch bolt actuating unit 4 that the first actuating rod 41 and the second actuating rod 42 are commonly turned by the inner lever 11. The actuating stick 43 is also turned a predetermined angle and consequently stopped in a horizontal direction. When the inner lever 11 returns to the original position, the first actuating rod 41 and the second actuating rod 42 are commonly returned. Initially, the lugs 432 of the actuating stick 43 are confined by the stops 442 of the limiting plate 44. The longitudinal legs 444 are aligned and combined with the notches 422 of the second actuating rod 42 until the second actuating rod 42 is turned a predetermined angle. Synchronously, the lugs 432 of the actuating stick 43 run on the inclined surface 424 of the second actuating rod 42 and slide into the gaps 423 of the second actuating rod 42 due to the biasing force of the first elastic member 46. Then the actuating stick 43 has an axial movement toward the inner lever mechanism 1. Consequently, the engaging protrusion 412 of the first actuating rod 41 is disengaged from the engaging groove 421 of the second actuating rod 42. Meanwhile, the arms 441 of the limiting plate 44 and the arms 451 of the reinforcing plate 45 are commonly disengaged from the locking recessions 223 of the rose escutcheon 22 by the biasing force of the second elastic member 47. Thereby, the latch bolt actuating unit 4 is returned to unlock.

Figure 10:
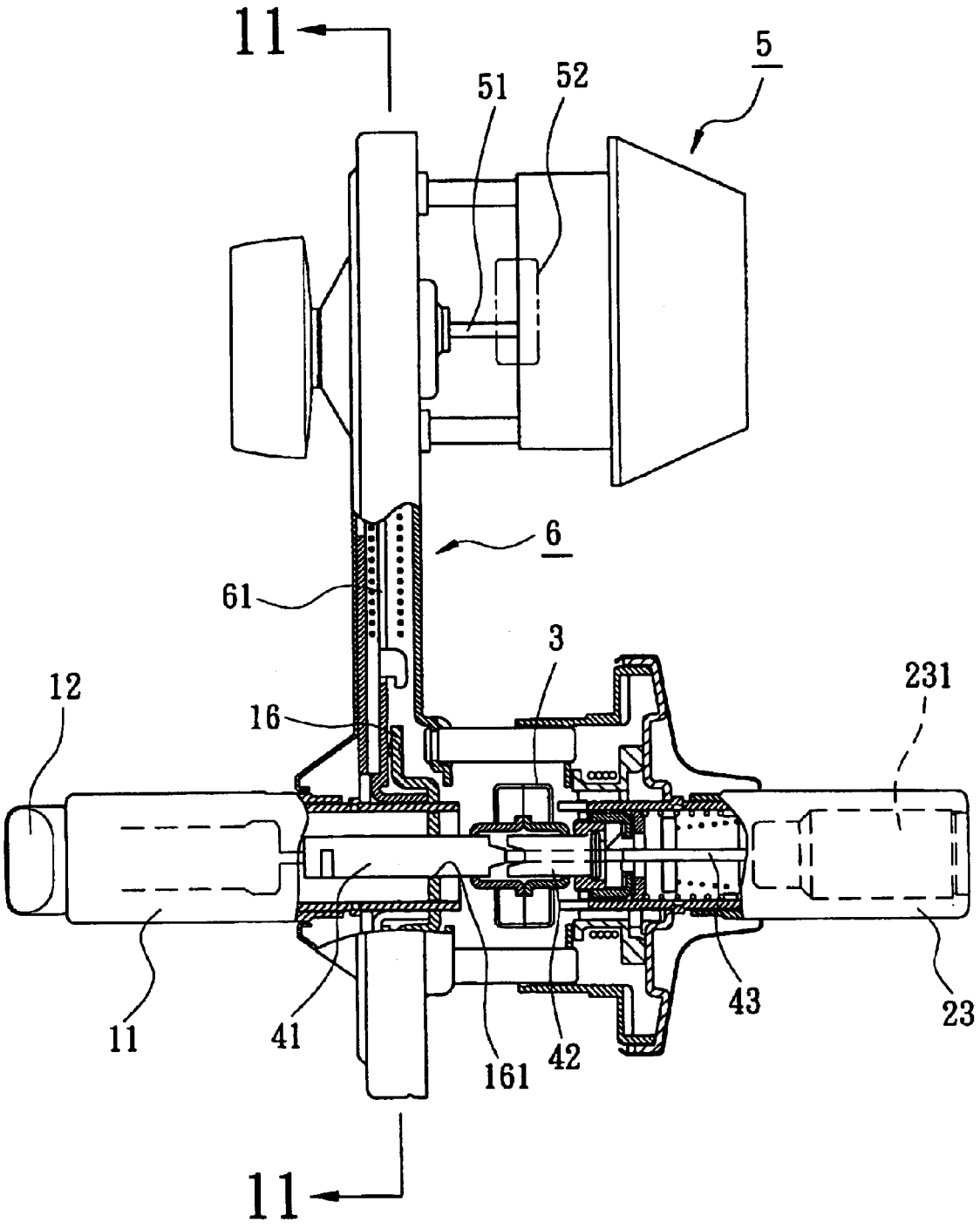
FIG. 10 is a partial cross-sectional view of the unlocking device for the lever handle door lock in accordance with the preferred embodiment of the present invention when assembled with an auxiliary lock.
Figure 11:
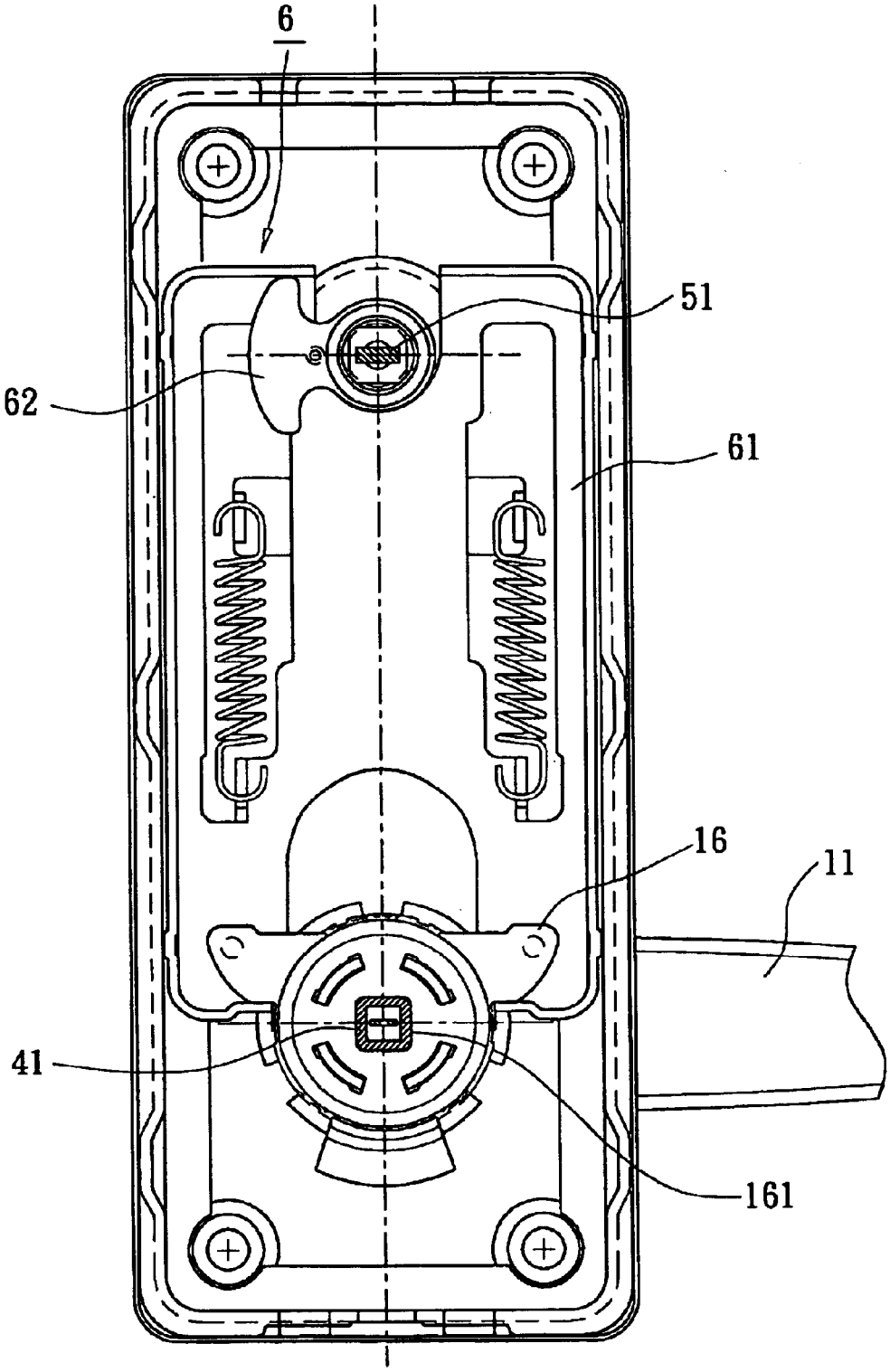
FIG. 11 is a cross-sectional view, taken along line 11—11 in FIG. 10, of the unlocking device for the lever handle door lock in accordance with the preferred embodiment of the present invention.

Turning now to FIGS. 10 and 11, the lever handle door lock is assembled with a combination of an auxiliary lock 5 and a connecting mechanism 6. The inner lever mechanism 1 further includes a pressing plate 16 and an assembling hole 161 thereof. The first actuating rod 41 is extended through the assembling hole 161 of the pressing plate 16 to combine therewith. The connecting mechanism 6 includes a connecting plate 61 having a first end connecting with the auxiliary lock 5, and a second end connecting with the inner lever 11 of the inner lever mechanism 1 via the pressing plate 16. Turning the pressing plate 16 may pull the connecting plate 61 down and thus it may result in rotation of an actuating cam 62. The auxiliary lock 5 includes an actuating stick 51 extended through the actuating cam 62 and combined therewith. When the connecting plate 61 rotates the actuating stick 51 and the actuating cam 62, a dead bolt 52 of the auxiliary lock 5 is retracted.

Referring back to FIG. 10, in the unlocking state, the first actuating rod 41 is disengaged and separated from the second actuating rod 42. Thus the inner lever 11 is able to synchronously retract the dead bolt 32 of the latch bolt unit 3 and the dead bolt 52 of the auxiliary lock 5 by turning the first actuating rod 41. When the auxiliary lock 5 is locked and the lever handle door lock is still maintained in the unlocking state, the outer lever 23 can turn the second actuating rod 42 but cannot turn the first actuating rod 41 which is disengaged from the second actuating rod 42. Under these conditions, the outer lever 23 is only permitted to retract the dead bolt 32 of the latch bolt unit 3 by turning the second actuating rod 42, and is not permitted to retract the dead bolt 52 of the auxiliary lock 5. Consequently, the outer lever 23 can avoid unlocking the auxiliary lock 5 by accident and increase the security in use.

Figure 12:
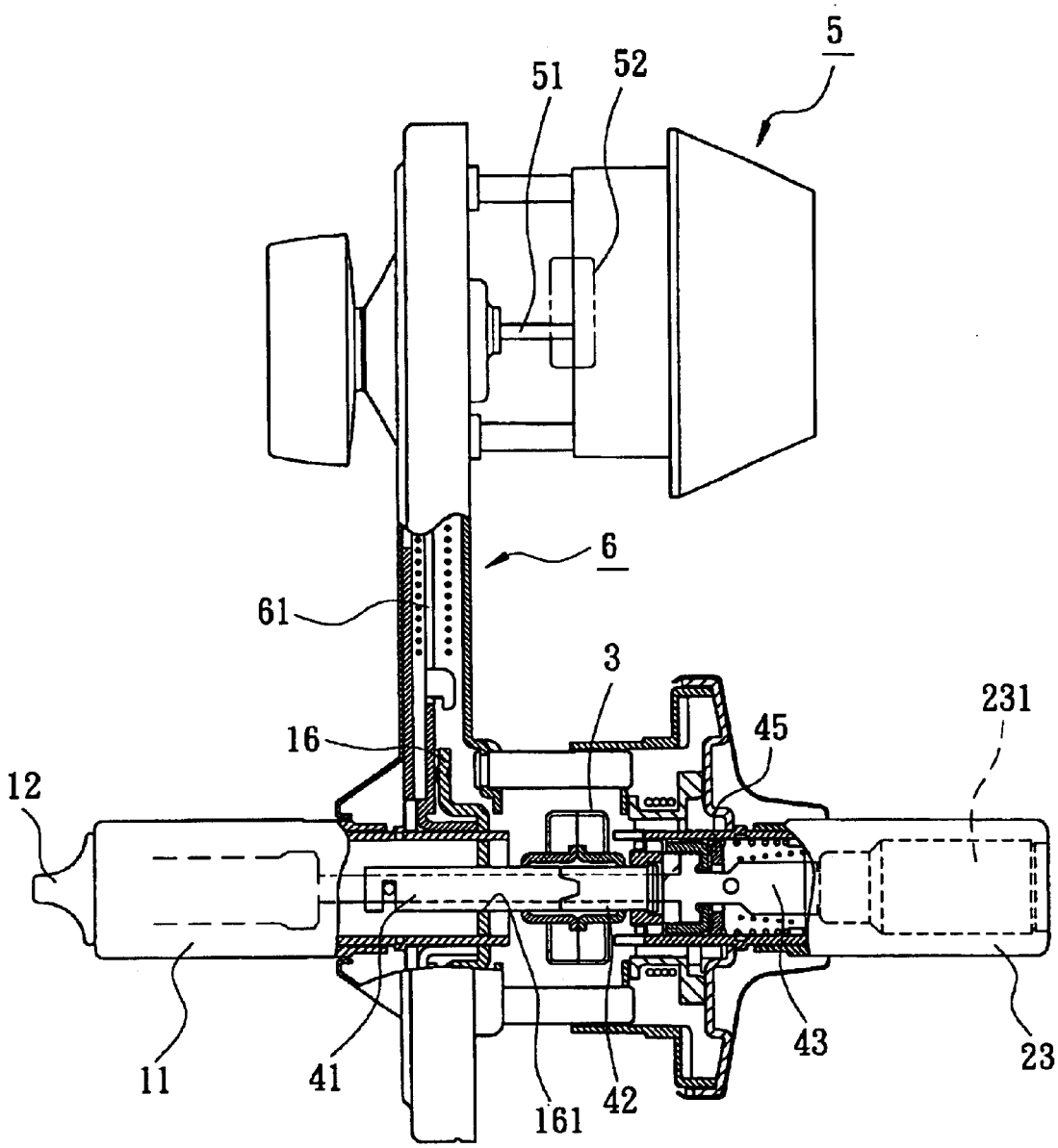
FIG. 12 is a partial cross-sectional view, similar to that of FIG. 10, of the unlocking device for the lever handle door lock, in locking state, in accordance with the preferred embodiment of the present invention.
Figure 13:
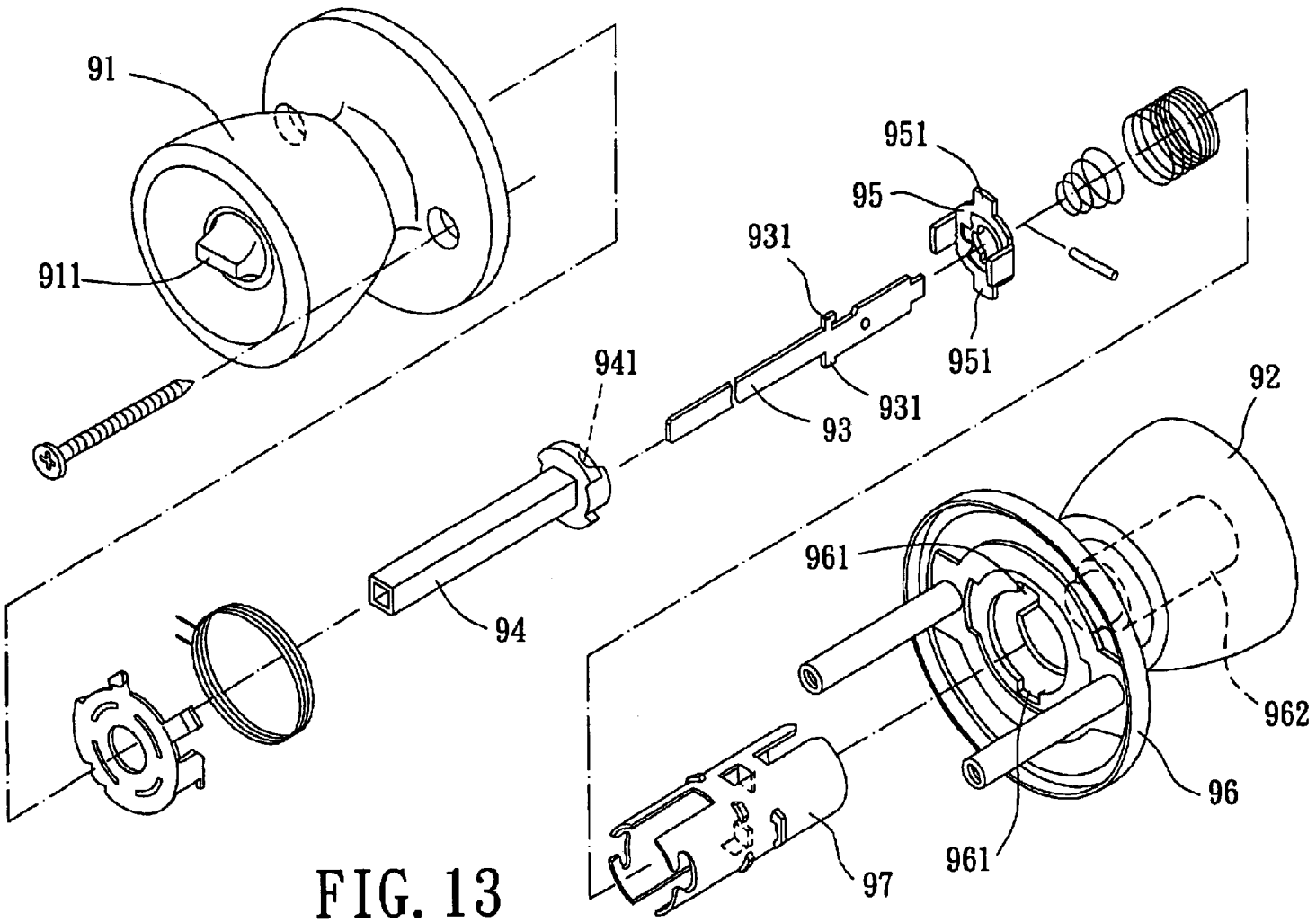
FIG. 13 PRIOR ART
FIG. 13 is an exploded perspective view of a tubular lock assembly in accordance with the prior art.

Turning now to FIG. 12, in the locking state, turning the locking button 12 or locking the lock core 231 can drive rotation of the actuating stick 43 to lock lever handle door lock. In the unlocking operation, turning the inner lever 11 can commonly turn the first actuating rod 41 and the second actuating rod 42 engaged therewith. Subsequently, the rotation of the first actuating rod 41 can retract the dead bolt 32 of the latch bolt unit 3 and the dead bolt 52 of the auxiliary lock 5. Meanwhile, the rotation of the second actuating rod 42 can permit turning the outer lever 23 to unlock the lever handle door lock.

The unlocking device for the lever handle door lock in accordance with the present invention carries out to synchronously unlock the lever handle door lock and the auxiliary lock in the locking state by turning the inner lever. In the unlocking state, turning the outer lever can avoid unlocking the auxiliary lock by accident.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. A unlocking device for a lever handle door lock, comprising:

an inner lever mechanism having an inner lever;

an outer lever mechanism having an outer lever corresponding to the inner lever;

a latch bolt unit including a first cam, a second cam and a dead bolt coupled to the first cam, and turning one of the first cam and the second cam can retract the dead bolt; and a latch bolt actuating unit provided with a first actuating rod, a second actuating rod and an actuating stick, the first actuating rod is aligned with the second actuating rod, and thus the actuating stick passes through the first actuating rod and the second actuating rod when assembled;

the first actuating rod having a first end connected to the inner lever mechanism, and a second end connected to the first cam of the latch bolt unit for driving it, the first end provided with a guiding groove while the second end providing with a first engaging portion;

the second actuating rod having a first end provided with a control cylinder to connect to the outer lever mechanism and the actuating stick, and a second end connected to the second cam of the latch bolt unit for driving it, the first end further provided with a limiting plate while the second end providing with a second engaging portion adapted to engage/disengage with/from the first engaging portion of the first actuating rod;

the actuating stick having a guiding rod being confined within the guiding groove of the first actuating rod to constitute a combination of the first actuating rod and the actuating stick, and at least one lug abutted on the control cylinder of the second actuating rod to allow a longitudinal movement between the combination of the first actuating rod and the actuating stick and the second actuating rod;

wherein when the lever handle door lock is situated in a locking state, the first engaging portion of the first actuating rod is engaged with the second engaging portion of the second actuating rod; the outer lever of the outer lever mechanism is not allowed to turn; and the inner lever of the inner lever mechanism is allowed to turn the first actuating rod and the second actuating rod so that the lever handle door lock is unlocked; and wherein when the lever handle door lock is situated in an unlocking state, the first engaging portion of the first actuating rod is disengaged and separated from the second engaging portion of the second actuating rod; the inner lever of the inner lever mechanism is able to turn the first actuating rod; and the outer lever of the outer lever mechanism is not allowed to turn the first actuating rod but to turn the second actuating rod so that the outer lever can avoid turning the first actuating rod by accident.

2. The unlocking device for the lever handle door lock as defined in claim 1, wherein the first engaging portion of the first actuating rod and the second engaging portion of the second engaging rod comprises an engaging protrusion and an engaging groove.

3. The unlocking device for the lever handle door lock as defined in claim 1, wherein the inner lever mechanism further including a pressing plate adapted to combine with a connecting mechanism for actuating an auxiliary lock.

4. The unlocking device for the lever handle door lock as defined in claim 3, wherein the connecting mechanism includes a connecting plate having a first end connecting with the auxiliary lock, and a second end connecting with the inner lever of the inner lever mechanism via the pressing plate.

5. The unlocking device for the lever handle door lock as defined in claim 4, wherein the auxiliary lock includes an actuating cam and an actuating stick extended therethrough, the actuating cam is driven by the connecting plate of the connecting mechanism.

6. The unlocking device for the lever handle door lock as defined in claim 1, wherein the actuating stick includes a positioning bar used to prevent releasing the limiting plate.

7. The unlocking device for the lever handle door lock as defined in claim 1, wherein the latch bolt actuating unit further includes a reinforcing plate attached to the limiting plate.

* * * * *